US007643762B2

(12) United States Patent
Eto

(10) Patent No.: US 7,643,762 B2
(45) Date of Patent: Jan. 5, 2010

(54) SHEET REMAINDER DETECTING DEVICE AND IMAGE FORMING APPARATUS

(75) Inventor: Daisuke Eto, Osaka (JP)

(73) Assignee: Kyocera Mita Corporation (JP)

( * ) Notice: Subject to any disclaimer, the term of this patent is extended or adjusted under 35 U.S.C. 154(b) by 562 days.

(21) Appl. No.: 11/641,432

(22) Filed: Dec. 19, 2006

(65) Prior Publication Data

US 2007/0140712 A1 Jun. 21, 2007

(30) Foreign Application Priority Data

Dec. 20, 2005 (JP) ..... 2005-366393

(51) Int. Cl.
*G03G 15/00* (2006.01)

(52) U.S. Cl. ..... 399/23; 399/393

(58) Field of Classification Search ..... 399/23; 271/145, 152

See application file for complete search history.

(56) References Cited

FOREIGN PATENT DOCUMENTS

| | | | |
|---|---|---|---|
| JP | 04-358648 | | 12/1992 |
| JP | 04-358649 | | 12/1992 |
| JP | 05229674 | A * | 9/1993 |
| JP | 05286604 | A * | 11/1993 |
| JP | 05286607 | A * | 11/1993 |
| JP | 2003226444 | A * | 8/2003 |
| JP | 2004137079 | A * | 5/2004 |

* cited by examiner

*Primary Examiner*—Judy Nguyen
*Assistant Examiner*—Allister Primo
(74) *Attorney, Agent, or Firm*—Gerald E. Hespos; Anthony J. Casella

(57) ABSTRACT

A sheet remainder detecting device for detecting the remaining amount of sheets in a sheet stack is provided with a displacing member displaceable according to the thickness of the sheet stack; a first and a second optical sensors each having a light emitting element for emitting light toward the displacing member and a light receiving element for receiving the light emitted by the light emitting element and reflected by the displacing member; and a controller for discriminating the remaining amount of the sheets based on detection signals of the first and second optical sensors. The displacing member includes a light irradiation region to be irradiated with the lights from the light emitting elements and movable according to an amount of displacement of the displacing member.

16 Claims, 9 Drawing Sheets

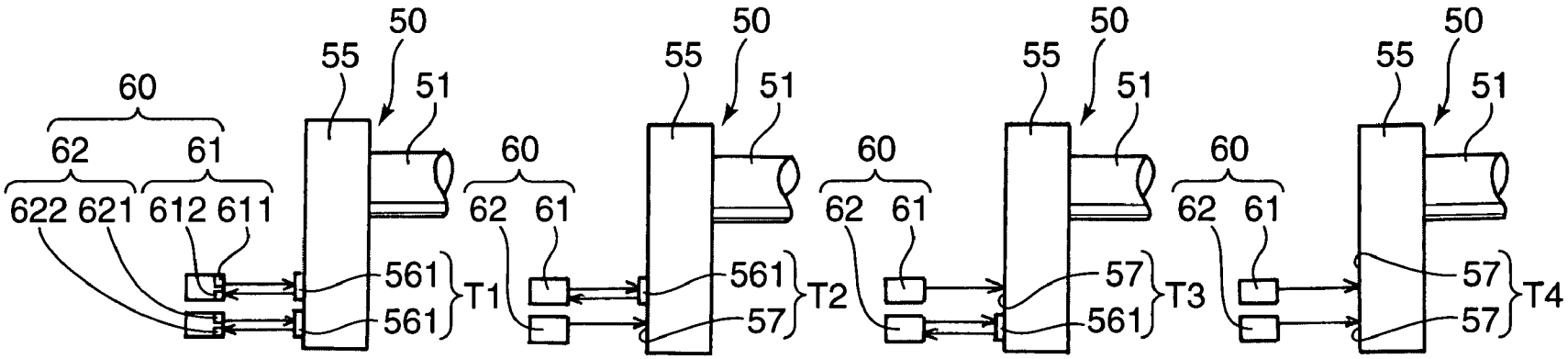
FIG. 8A
FIG. 8B
FIG. 8C
FIG. 8D
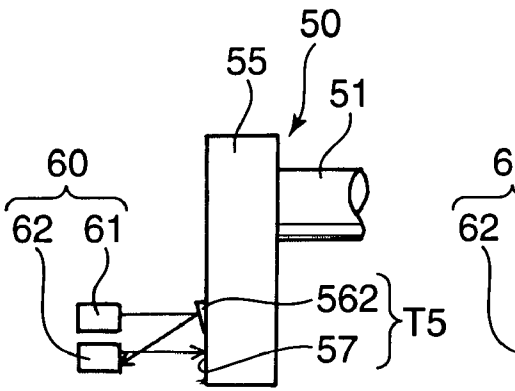
FIG. 8E
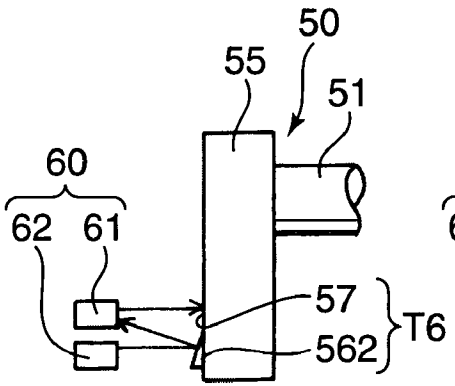
FIG. 8F
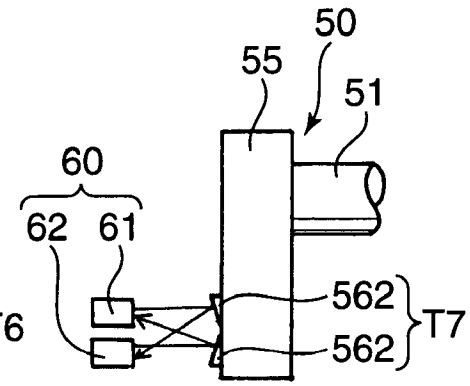
FIG. 8G

SHEET REMAINDER DETECTING DEVICE AND IMAGE FORMING APPARATUS

BACKGROUND OF THE INVENTION

1. Field of the Invention

The present invention relates to a sheet remainder detecting device for detecting the remaining amount of sheets in a sheet stack and an image forming apparatus employing such a device.

2. Description of the Related Art

There has been conventionally known a sheet remainder detecting device applied to an image forming apparatus as disclosed in Japanese Unexamined Patent Publication No. H04-358648. This sheet remainder detecting device employs a sheet placing plate constructed to lift as the number of sheets is decreased as the sheets are successively fed from a sheet stack placed thereon. This detecting device further includes a light reflector fixed to the sheet placing plate, a plurality of light emitting elements arranged along a movable range of this light reflector for emitting lights toward the light reflector, and a plurality of light receiving elements provided in correspondence with the respective light emitting elements for receiving the lights reflected by the light reflector.

The remaining amount of the sheets on the sheet placing plate is detected by discriminating based on detection signals outputted from the light receiving elements which light receiving element received the light from which light emitting element via the light reflector. According to such a sheet remainder detecting device, a sheet replenishment timing can be known before the sheets run out, actions such as notification to replenish the sheets can be made beforehand, which is convenient because the prolongation of a sheet run-out state can be prevented.

However, the sheet remainder detecting device of the above publication necessitates a multitude of expensive light emitting elements and light receiving elements, thereby presenting a problem of a high parts cost.

SUMMARY OF THE INVENTION

It is an object of the present invention to provide a sheet remainder detecting device capable of effectively detecting the remaining amount of sheets while contributing to a reduction in parts cost and an image forming apparatus employing such a device.

In order to accomplish this object, one aspect of the present invention is directed to a sheet remainder detecting device, comprising a displacing member displaceable according to the thickness of the sheet stack; a first and a second optical sensors each having a light emitting element for emitting light toward the displacing member and a light receiving element for receiving the light emitted by the light emitting element and reflected by the displacing member; and a controller for discriminating the remaining amount of the sheets based on detection signals of the first and second optical sensors; the displacing member including a light irradiation region to be irradiated with the lights from the light emitting elements and movable according to an amount of displacement of the displacing member, and the light irradiation region having a first reflecting surface for reflecting the light emitted from the light emitting element of the first optical sensor so that the light receiving element of the first optical sensor can receive light; a second reflecting surface for reflecting the light emitted by the light emitting element of the first optical sensor so that the light receiving element of the second optical sensor can receive light; a third reflecting surface for reflecting the light emitted from the light emitting element of the second optical sensor so that the light receiving element of the second optical sensor can receive light; and a fourth reflecting surface for reflecting the light emitted by the light emitting element of the second optical sensor so that the light receiving element of the first optical sensor can receive light.

Further, another aspect of the present invention is directed to an image forming apparatus, comprising a sheet storing unit for storing a sheet stack, an image forming unit for applying an image forming operation to a sheet dispensed from the sheet stack, and a sheet remainder detecting device for detecting the remaining amount of the sheets in the sheet stack, the sheet remainder detecting device having the above construction.

BRIEF DESCRIPTION OF THE DRAWINGS

FIGS. 8A to 8G are graphical representations of the contents of TABLE-1, wherein FIG. 8A shows a state where first sections of the fan-shaped element face optical sensors, FIG. 8B shows a state where second sections of the fan-shaped element face the optical sensors, FIG. 8C shows a state where third sections of the fan-shaped element face the optical sensors, FIG. 8D shows a state where fourth sections of the fan-shaped element face the optical sensors, FIG. 8E shows a state where fifth sections of the fan-shaped element face the optical sensors, FIG. 8F shows a state where sixth sections of the fan-shaped element face the optical sensors, and FIG. 8G shows a state where seventh sections of the fan-shaped element face the optical sensors.

DETAILED DESCRIPTION OF THE PREFERRED EMBODIMENTS

Hereinafter, one embodiment of the present invention is described in detail.

Figure 1:
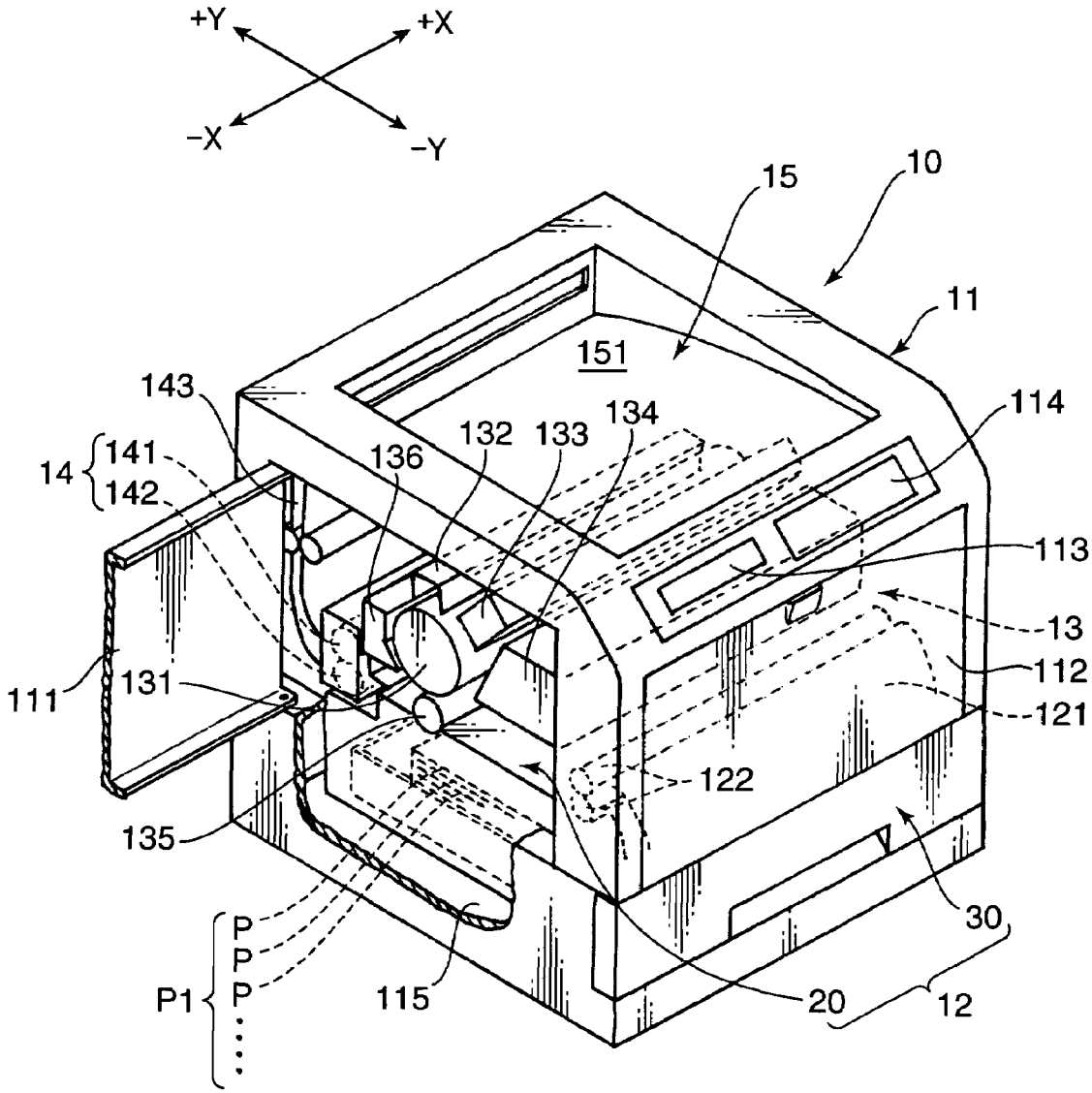
FIG. 1 is a perspective view partly cut away showing one embodiment of the internal construction of a printer to which a sheet remainder detecting device according to the invention is applied.

FIG. 1 is a perspective view partly cut away showing one embodiment of the internal construction of a printer 10 to which a sheet remainder detecting device 40 according to the invention is applied. It should be noted that X-X directions and Y-Y directions in FIG. 1 are referred to as transverse directions (width direction) and forward and backward directions, respectively, wherein −X direction is leftward direction, +X direction rightward direction, −Y direction forward direction and +Y direction backward direction.

As shown in FIG. 1, the printer (image forming apparatus) 10 is constructed such that a sheet storing unit 12 provided at a bottom part for storing sheets P used for printing, an image forming unit 13 for applying an image transferring operation to each one of the sheets P dispensed from a sheet stack P1 stored in the sheet storing unit 12, and a fixing unit 14 for applying an image fixing operation to the sheet P having the image transferred thereto in the image forming unit 13 are installed in an apparatus main body 11 and a sheet discharging unit 15 to which the sheet P having the image fixed thereto in the fixing unit 14 is discharged is provided atop the apparatus main body 11.

An openable and closable maintenance door 111 is provided substantially in the upper half of a left wall of the apparatus main body 11, and the inside of the apparatus main body 11 is exposed by opening this door 111. A manual insertion tray 112 that doubles as an open door is provided at the front wall of the apparatus main body 11, and a sheet P can be manually fed into the image forming unit 13 via the upper surface of the manual insertion tray 112 by turning this tray 112 forward.

An inclined surface inclined down toward the front is formed at the upper edge of the front surface of the apparatus main body 11, wherein an operation panel 113 and an LCD (liquid crystal display) 114 are arranged on this inclined surface. Various pieces of operation information are inputted by means of the operation panel 113 and various comments for the image forming operation are outputted in the form of characters to the LCD (notifying element) 114.

The sheet storing unit 12 is provided with a cassette frame 20 integral to the apparatus main body 11, and a specified number (one in this embodiment) of sheet cassette(s) 30 each containing the sheet stack P1 is/are detachably mounted into the cassette frame 20 from front. The sheets P dispensed one by one from the sheet stack P1 in the sheet cassette 30 are fed to the image forming unit 13 via a feeding conveyance path 121 and a pair of registration rollers 122 disposed downstream of the feeding conveyance path 121.

The image forming unit 13 is for transferring a toner image to the sheet P based on image information electrically transmitted from a computer or the like, and is constructed such that a charging device 132, an exposing device 133, a developing device 134, a transfer roller 135 and a cleaning device 136 are arranged in clockwise direction along the outer circumferential surface of a photoconductive drum 131 rotatably disposed about a central axis thereof extending in width direction from a position right above the photoconductive drum 131.

The photoconductive drum 131 is for forming an electrostatic latent image and a toner image in conformity with this electrostatic latent image on the outer circumferential surface thereof. An amorphous silicon layer is formed on the outer circumferential surface of the photoconductive drum 131.

The charging device 132 is for uniformly charging the outer circumferential surface of the photoconductive drum 131 rotating in clockwise direction about the central axis thereof. In an example shown in FIG. 1, the charging device 132 adopts a method according to which electric charges are imparted to the outer circumferential surface of the photoconductive drum 131 by the corona discharge. Instead of the charging device 132, a charging roller having the outer circumferential surface thereof held in contact with that of the photoconductive drum 131 for imparting electric charges by the driven rotation thereof may be adopted as a member for imparting electric charges to the outer circumferential surface of the photoconductive drum 131.

The exposing device 133 emits a laser beam modulated based on an image data electrically transmitted from an external apparatus such as a computer to the outer circumferential surface of the rotating photoconductive drum 131. An electrostatic latent image is formed on this outer circumferential surface of the photoconductive drum 131 by removing the electric charges in parts irradiated with the laser beam.

The developing device 134 is for attaching toner particles to the parts of the outer circumferential surface of the photoconductive drum 131 where the electrostatic latent image is formed by supplying the toner particles to this outer circumferential surface, thereby forming a toner image on the outer circumferential surface of the photoconductive drum 131.

The transfer roller 135 is for transferring the positively charged toner image formed on the outer circumferential surface of the photoconductive drum 131 to the sheet P fed to the position right below the photoconductive drum 131. The transfer roller 135 imparts negative electric charges having polarity opposite to those of the toner image to the sheet P.

Accordingly, the sheet P having reached a position right below the photoconductive drum 131 is negatively charged while being pressed between the transfer roller 135 and the photoconductive drum 131. Then, the toner image on the outer circumferential surface of the positively charged photoconductive drum 131 is separated toward the front side of the sheet P, whereby the image is transferred to the sheet P.

The cleaning device 136 is for cleaning the outer circumferential surface of the photoconductive drum 131 by removing the residual toner on the outer circumferential surface of the photoconductive drum 131 after the image transferring operation. The outer circumferential surface of the photoconductive drum 131 cleaned by this cleaning device 136 heads toward the charging device 132 again for a next image forming operation.

The fixing unit 14 is for fixing the toner image transferred to the sheet P in the image forming unit 13 to the sheet P by heating. The fixing unit 14 includes a heating roller 141 having an electric heating element mounted therein, and a pressure roller 142 whose outer circumferential surface is opposed to that of the heating roller 141 from below. The sheet P after the image transferring operation receives heat from the heating roller 141 to have the toner image fixed by passing a nip between the heating roller 141 drivingly rotated in clockwise direction about its central axis and the pressure roller 142 driven to rotate in counterclockwise direction about its central axis. The sheet P having the image fixing operation applied thereto is discharged to the sheet discharging unit 15 through a discharging conveyance path 143.

The sheet discharging unit 15 is formed by recessing the top of the apparatus main body 11, and a sheet discharge tray 151 for receiving the discharged sheet P is formed at the bottom of the thus formed recess.

Figure 2:
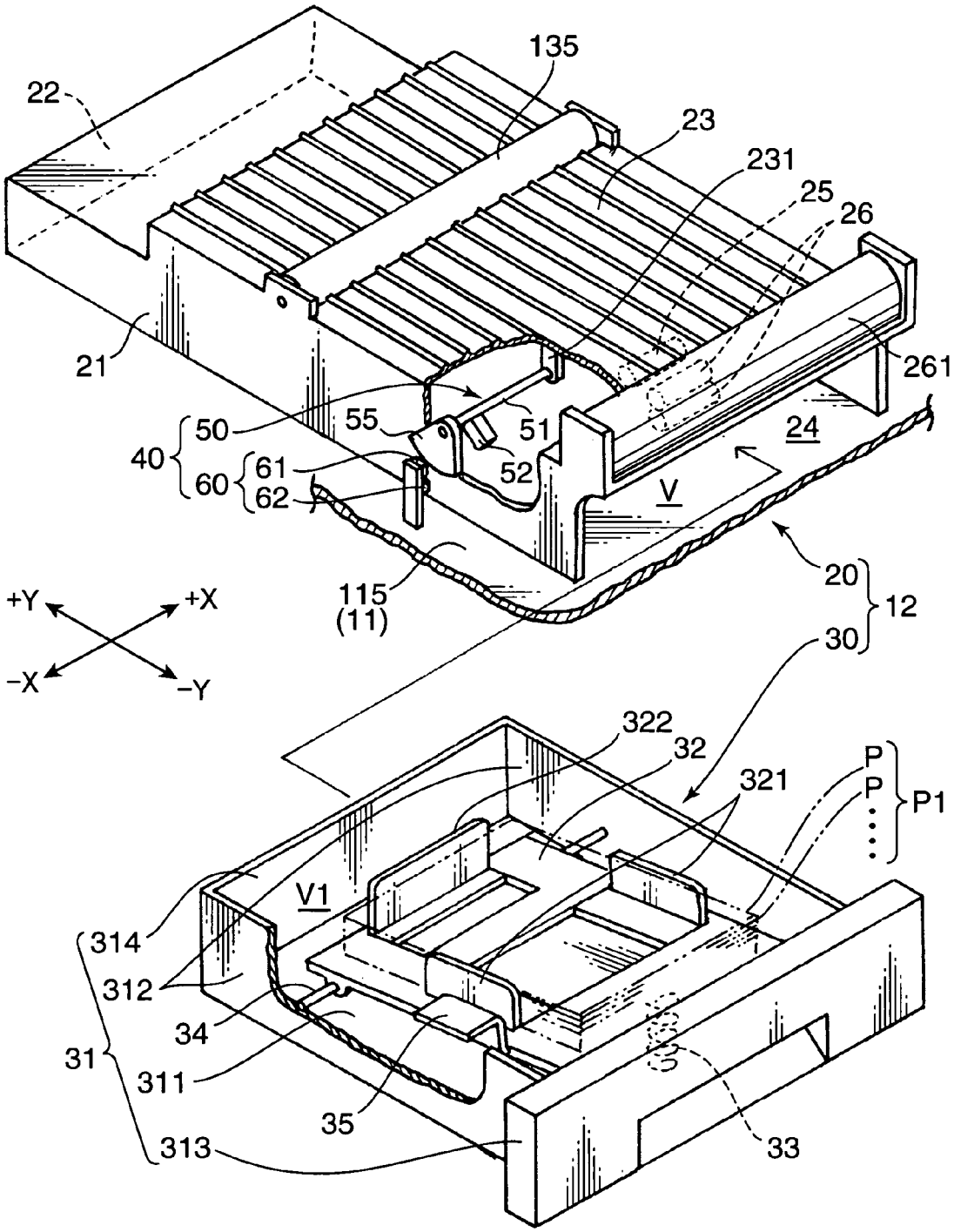
FIG. 2 is a perspective view showing one embodiment of a cassette frame applied to the printer of FIG. 1 in a state where a sheet cassette is withdrawn from the cassette frame.
Figure 3:
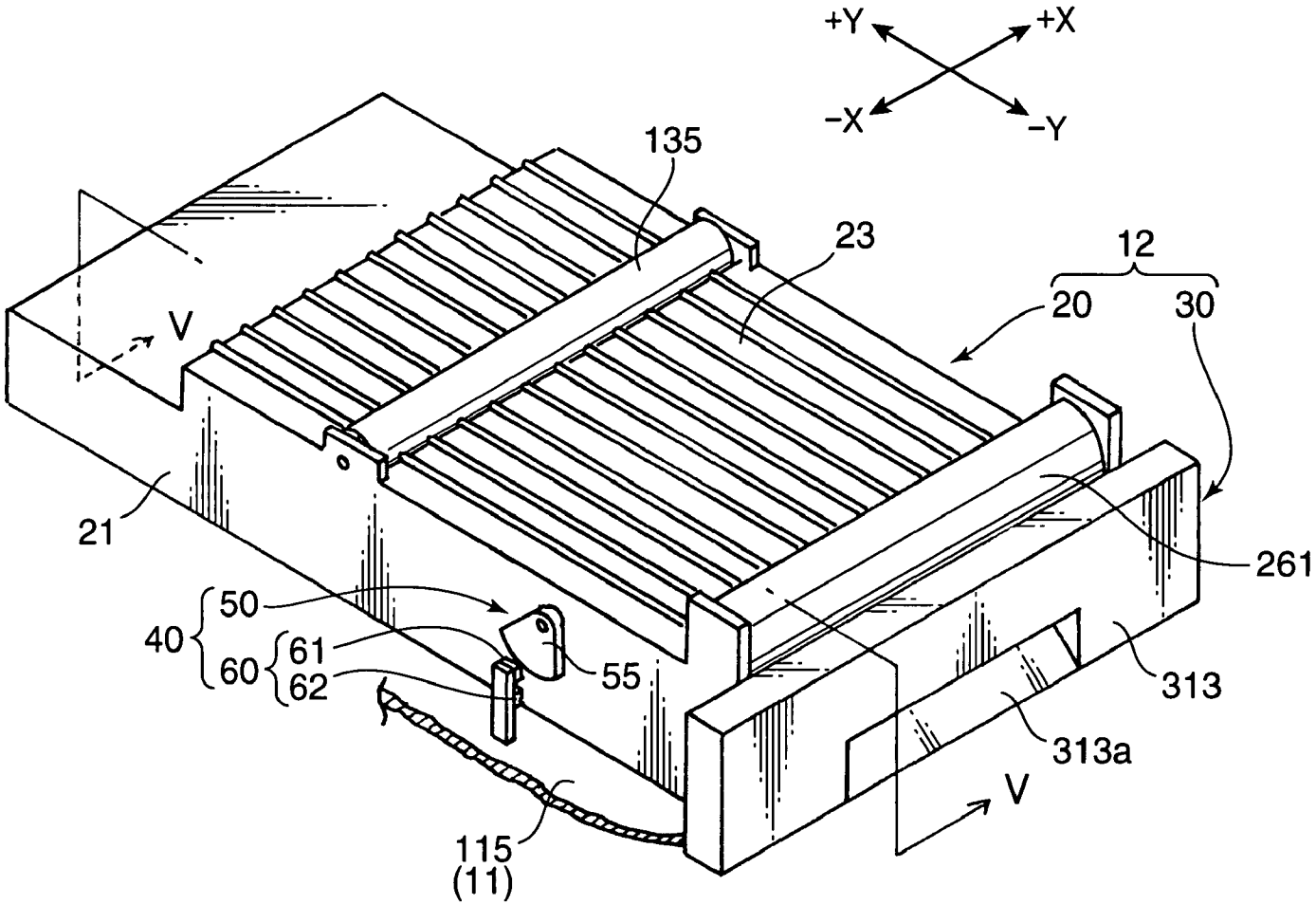
FIG. 3 is a perspective view showing the one embodiment of the cassette frame in a state where the sheet cassette is accommodated in the cassette frame.
Figure 4:
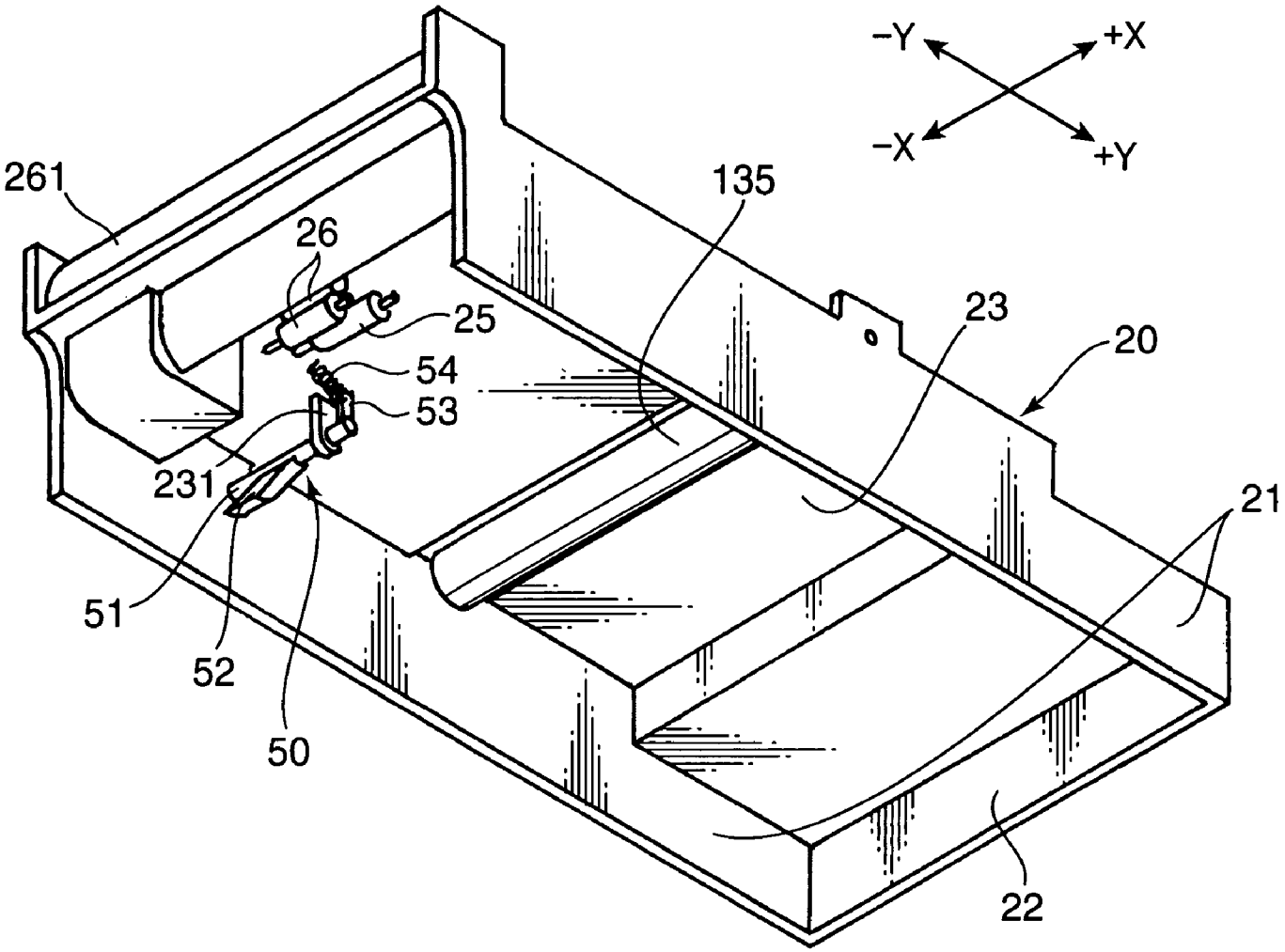
FIG. 4 is a perspective view of the cassette frame when viewed obliquely from below.
Figure 5:
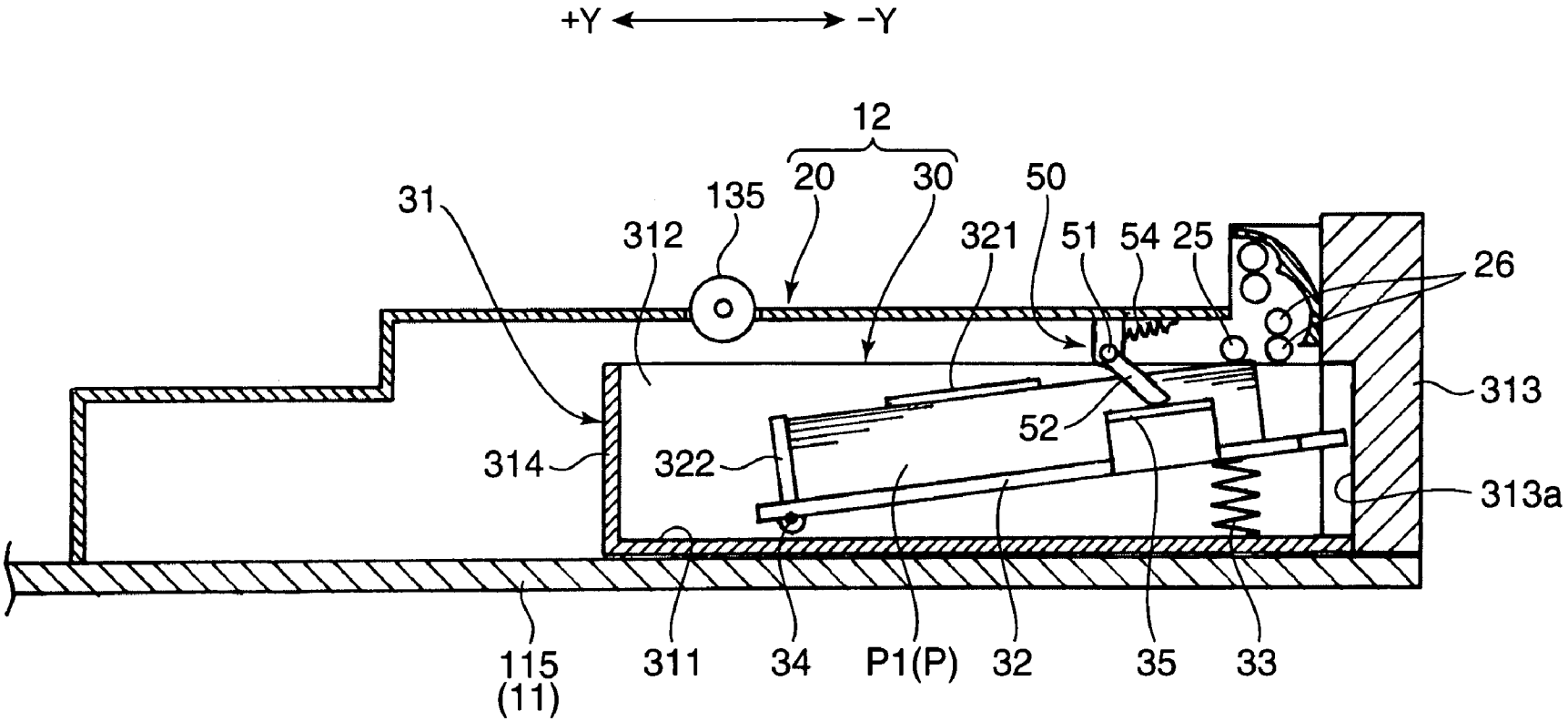
FIG. 5 is a section along V-V of FIG. 3.

The sheet remainder detecting device 40 according to the embodiment of the present invention is provided in the cassette frame 20 of the sheet storing unit 12 of such a printer 10. Hereinafter, the cassette frame 20 is first described in connection with the sheet cassette 30. FIGS. 2 and 3 are perspective views showing one embodiment of the cassette frame 20, wherein FIG. 2 shows a state where the sheet cassette 30 is withdrawn from the cassette frame 20 and FIG. 3 shows a state where the sheet cassette 30 is accommodated in the cassette frame 20. FIG. 4 is a perspective view of the cassette frame 20 when viewed obliquely from below. FIG. 5 is a section along V-V of FIG. 3. It should be noted that directions indicated by X and Y in FIGS. 2 to 5 are similar to the case of FIG. 1 (X are transverse directions (−X: leftward direction, +X: rightward direction) and Y are forward and backward directions (−Y: forward direction, +Y: backward direction)).

As shown in these figures, the cassette frame 20 is provided with a pair of side plates 21 spaced apart in width direction, a rear plate 22 bridging the rear edges of this pair of side plates 21, and a ceiling plate 23 bridging the upper edges of the side plates 21 and the rear plate 22, and has an inverted U-shape in front view. Such a cassette frame 20 is formed with an insertion opening 24, which is for enabling the sheet cassette 30 to be inserted into and withdrawn from the cassette frame 20 from and toward the front side with the bottom edges of the respective side plates 21 and the rear plate 22 fixed to a bottom plate 115 of the apparatus main body 11 by means of screws, welding or the like.

A mounting space V into which the sheet cassette 30 is mounted is formed by a space enclosed by the pair of side plates 21, the rear plate 22, the ceiling plate 23 and the bottom plate 115 of the apparatus main body 11. In this embodiment, the ceiling plate 23 also functions as a conveyance path for the sheet P dispensed from the sheet cassette 30.

A pickup roller 25 is disposed at a front upper part of the cassette frame 20 between the pair of side plates 21. A pair of conveyance rollers 26 are arranged one above the other at a position before this pickup roller 25 between the pair of side plates 21. The pickup roller 25 is drivingly rotated about its central axis by an unillustrated drive motor with the sheet cassette 30 mounted in the mounting space V, whereby the uppermost sheet P of the sheet stack P1 is dispensed forward.

The pair of conveyance rollers 26 is for turning the sheet P dispensed by the pickup roller 25 onto the ceiling plate 23 while tightly holding the sheet p at a nip therebetween. In order to turn the sheet P, an arcuate guiding plate 261 formed to have an arcuate cross section so as to extend along the upper one of the pair of conveyance rollers 26 is provided at the front upper end of the cassette frame 20. The sheet P conveyed by the pair of conveyance rollers 26 is moved onto the ceiling plate 23 while being guided by the inner surface of this arcuate guiding plate 261.

The sheet remainder detecting device 40 according to this embodiment is disposed at a position slightly behind the pickup roller 25 in such a cassette frame 20 and described in detail later.

The sheet cassette 30 includes a flat box-shaped cassette main body 31 having an open upper surface, a lifting plate 32 for lifting the sheet stack P1 accommodated in the cassette main body 31, and a compression coil spring 33 for biasing the lifting plate 32 upward.

The cassette main body 31 is comprised of a bottom plate 311 rectangular in plan view and dimensioned in such a manner as to be mountable into the mounting space V of the cassette frame 20, a pair of side plates 312 spaced apart in width direction and standing from the respective lateral edges of the bottom plates 311 opposed to each other in width direction, a decorative laminate 313 fixed in contact with the front edges of the bottom plate 311 and the respective side plates 312, and a rear plate 314 standing from the rear edge of the bottom plate 311. A storage space V1 for storing the sheet stack P1 is defined inside the cassette main body 31.

The sheet stack P1 is placed on the lifting plate 32. A pair of width defining guides 321 elongated in forward and backward directions, projecting upward and adapted to restrict movements of the sheet stack pl along width direction are provided at the left and right edges of the lifting plate 32. A rear-end defining guide 322 for defining the rear end position of the sheet stack P1 is provided at the rear end of the lifting plate 32. The sheets P are positioned in the storage space V1 by being placed on the lifting plate 32 within a range enclosed by the pair of width defining guides 321 and the rear-end defining guide 322.

The lifting plate 32 is rotatably supported at its back position about a supporting shaft 34 extending between bottom positions of the pair of side plates 312. The compression coil spring 33 is disposed between the bottom plate 311 and the lifting plate 32 in a compressed state at a position before the supporting shaft 34. Thus, a biasing force of a counterclockwise direction (i.e. in such a direction as to lift up the front edge of the lifting plate 32) about the supporting shaft 34 constantly acts on the lifting plate 32 by a biasing force of the compression coil spring 33.

As shown in FIG. 5, the front edge of the lifting plate 32 is fitted in a recess 313*a* formed in the rear surface of the decorative laminate 313. The lifting plate 32 does not rotate in counterclockwise direction any further about the supporting shaft 34 (i.e. the front edge thereof moves any further upward) due to the interference of the front edge thereof with the upper edge of the recess 313*a*.

In this embodiment, a contact plate 35 elongated in forward and backward directions is provided to project leftward from the left edge of the lifting plate 32. This contact plate 35 is for integrally rotating a fan-shaped element 55 about a rotary shaft 51 via a later-described striker 52 by interfering with the striker 52 of the sheet remainder detecting device 40.

In the sheet cassette 30 constructed as above, the sheet stack P1 is placed on the lifting plate 32 while being positioned by the pair of width defining guides 321 and the rear-end defining guide 322. When the sheet cassette 30 of this state is inserted into the mounting space V of the cassette frame 20 through the insertion opening 24, the uppermost sheet P of the sheet stack P1 first comes into sliding contact with the arcuate guiding plate 261. If the sheet cassette 30 continues to be pushed into the mounting space V in this state, the sheet stack P1 is relatively pushed by the arcuate guiding plate 261. By a clockwise rotation of the lifting plate 32 about the supporting shaft 34 against the biasing force of the compression coil spring 33 caused by this pressing, the sheet stack P1 passes under the arcuate guiding plate 261. In this way, the sheet cassette 30 is mounted into the mounting space V of the cassette frame 20.

With the sheet cassette 30 mounted in the mounting space V of the cassette frame 20, the uppermost sheet P of the sheet stack P1 is pressed in contact with the pickup roller 25 by the biasing force of compression coil spring 33. The uppermost sheet P of the sheet stack P1 is dispensed by the pickup roller 25 by drivingly rotating the pickup roller 25 in counterclockwise direction about its central axis in this state. The leading end of this dispensed sheet P is immediately caught by the nip between the conveyance rollers 26, strongly pulled out, and guided by the arcuate guiding plate 261 to be discharged onto the ceiling plate 23.

Figure 6:
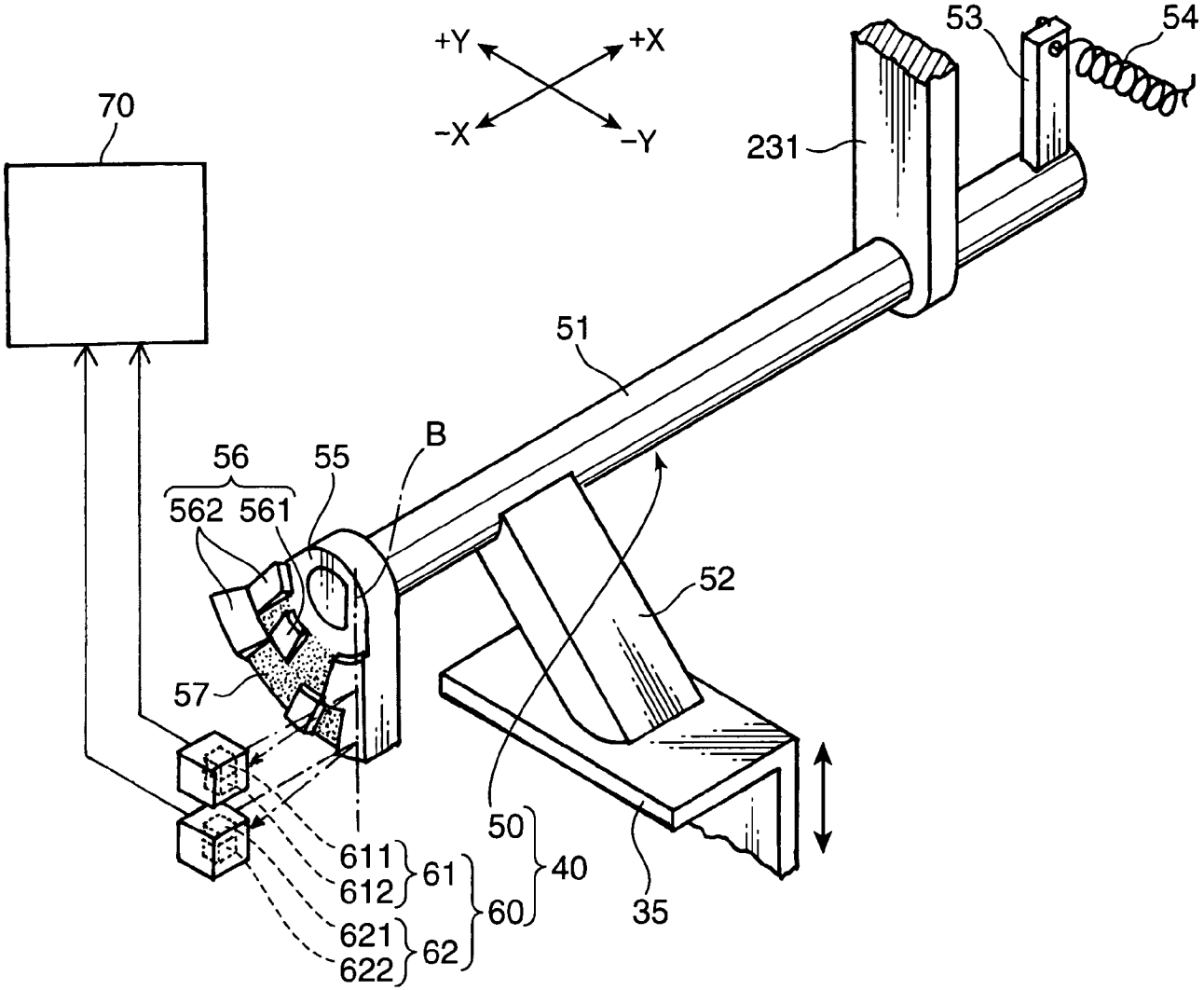
FIG. 6 is a perspective view showing one embodiment of the sheet remainder detecting device.

The sheet remainder detecting device 40 according to this embodiment is mounted in such a cassette frame 20. FIG. 6 is a perspective view showing one embodiment of the sheet remainder detecting device 40. The sheet remainder detecting device 40 is described below with reference to FIG. 6 and, if necessary, also to FIGS. 1 to 5. It should be noted that directions indicated by X and Y in FIG. 6 are similar to the case of FIG. 2 (X are transverse directions (−X: leftward direction, +X: rightward direction) and Y are forward and backward directions (−Y: forward direction, +Y: backward direction)).

As shown in FIG. 6, the sheet remainder detecting device 40 is provided with a displacing member 50 displaceable according to the thickness of the sheet stack P1 placed on the lifting plate 32, a pair of optical sensors 60 (first optical sensor 61 and second optical sensor 62) for emitting lights toward the displacing member 50, and a controller 70 for discriminating the remaining amount of the sheets based on detection signals from the pair of optical sensors 60.

The displacing member 50 includes the rotary shaft 51, the striker 52, a projecting piece 53, an extension coil spring 54 and the fan-shaped element 55 (corresponding to a "fan-shaped member" of the claimed invention). The rotary shaft 51 is disposed to extend in transverse direction at a position slightly behind the pickup roller 25 in the cassette frame 20 and is rotatable about its central axis. The striker 52 is a member projecting obliquely forward at a position at the left side of the rotary shaft 51 so that it can come into contact with the contact plate 35. The projecting piece 53 is a member projecting upward from the right end of the rotary shaft 51. The extension coil spring 54 spans in an elongated manner between the upper end of the projecting piece 53 and a suitable position of the front side of the ceiling plate 23 of the cassette frame 20. The fan-shaped element 55 is made of a plate-shaped member having a fan shape, and is fixed to the left end of the rotary shaft 51 in the vicinity of the center of curvature of the arcuate edge thereof.

The left end of the rotary shaft 51 penetrates the left side plate 21 of the cassette frame 20 while being held in sliding contact therewith, and the rotary shaft 51 penetrates a bottom end of a bearing lever 231 (see FIG. 4) suspending from the ceiling plate 23 of the cassette frame 20 in such a manner as to be held in sliding contact with this bottom end at a position slightly to the left from the projecting piece 53. The rotary shaft 51 rotates about its central axis while being supported on the side plate 21 and the bearing lever 231.

When the lifting plate 32 is rotated little by little in counterclockwise direction about the supporting shaft 34 by the biasing force of the compression coil spring 33 as the sheets P are dispensed one by one from the sheet stack P1 placed on the lifting plate 32 by driving the pickup roller 25, the contact plate 35 integral to the lifting plate 32 accordingly moves upward little by little. The leading end of the striker 52 is moved upward by this upward movement, whereby the rotary shaft 51 rotates in counterclockwise direction about its central axis. By this rotation, the fan-shaped element 55 fixed to the left end surface of the rotary shaft 51 rotates in counterclockwise direction about the center of curvature (i.e. the central axis of the rotary shaft 51).

Figure 7:
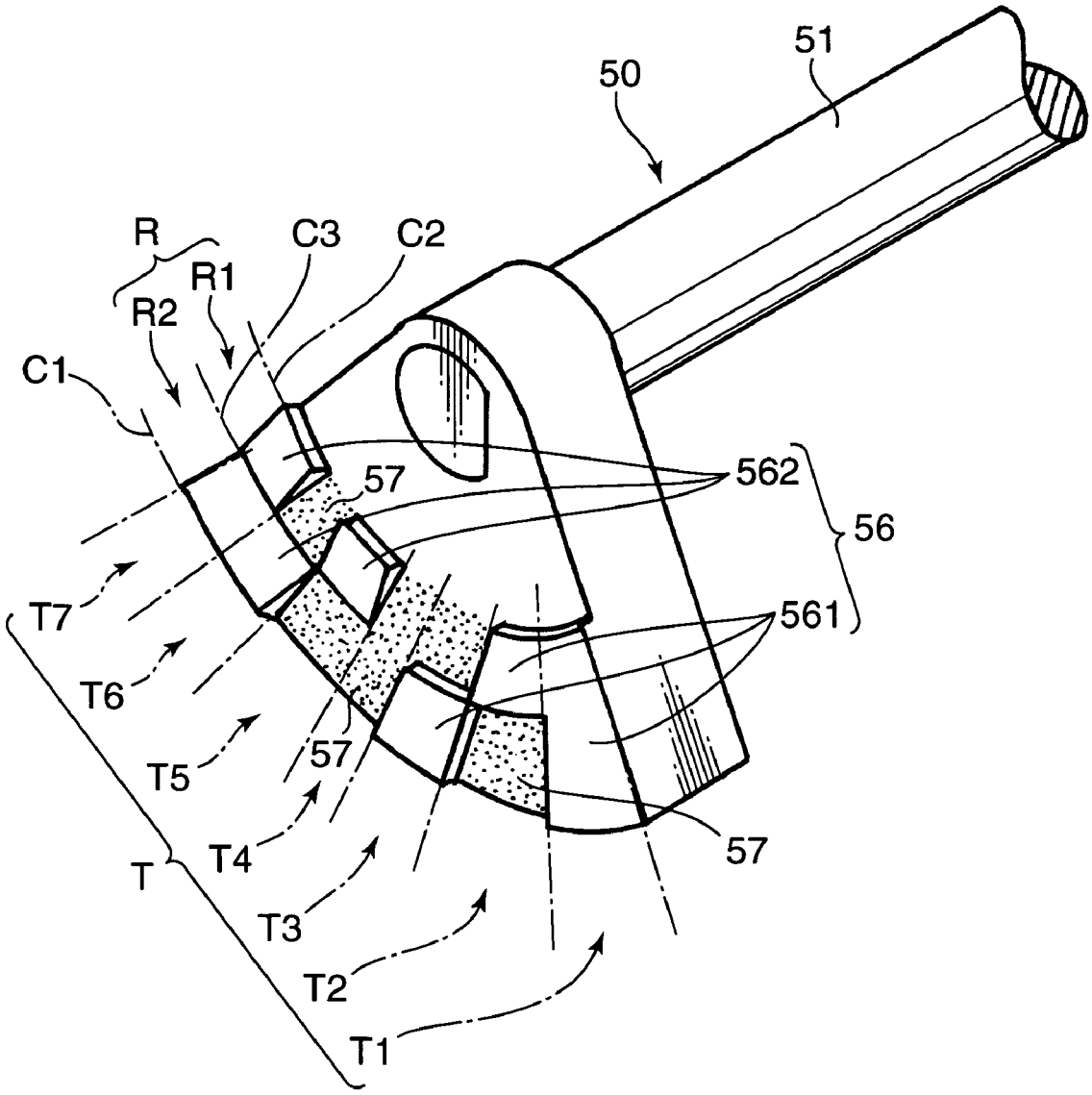
FIG. 7 is an enlarged view of a fan-shaped element provided in the sheet remainder detecting device of FIG. 6.

In this embodiment, a light irradiation area R to be irradiated with lights from light emitting elements of the optical sensors 60 is provided on the left surface (surface facing the optical sensors 60) of the fan-shaped element 55 that is a component of the displacing member 50 as shown in FIG. 7, which is an enlarged view of the fan-shaped element 55. The light irradiation area R according to this embodiment is a curved surface including a plurality of reflecting surfaces 56 for reflecting the lights from the optical sensors 60 and a plurality of absorbing surfaces 57 for absorbing the lights from the optical sensors 60, and extending along an arcuate contour of the fan-shaped element 55. Since being integrally formed on the fan-shaped element 55, the light irradiation area R is moved according to an amount of displacement of the fan-shaped element 55 (amount of rotation of the rotary shaft 51). The controller 70 discriminates the remaining amount of the sheets P placed on the lifting plate 32 based on detection results of the optical sensors 60 concerning the lights emitted to and received from the light irradiation area R including the reflecting surfaces 56 and the absorbing surfaces 57.

The light irradiation area R is comprised of a first irradiation range R1 facing the first optical sensor 61 that is the upper one of the optical sensors 60 and a second irradiation range R2 facing the second optical sensor 62 that is the lower one of the optical sensors 60. Here are assumed a maximum arcuate curve C1 defined by the arcuate edge of the fan-shaped element 55, a minimum arcuate curve C2 defined by a radius of curvature that is substantially half the radius of curvature of the fan-shaped element 55, and an intermediate arcuate curve C3 defined by an intermediate radius of curvature between the maximum and minimum arcuate curves C1, C2. The first irradiation range R1 is an arcuate surface located in a region between the maximum and intermediate arcuate curves C2 and C3, whereas the second irradiation range R2 is an arcuate surface located in a region between the maximum and intermediate arcuate curves C1, C3.

Each of the first and second irradiation ranges R1, R2 is equally divided into seven sections along directions of the radius of curvature, wherein the reflecting surface 56 or the absorbing surface 57 is formed on each section T (first to seventh sections T1 to T7 from the front side to the rear side in FIG. 6). The reflecting surfaces 56 include orthogonal reflecting surfaces 561 that are surfaces substantially orthogonal to light paths of the lights horizontally emitted from the optical sensors 60 and inclined reflecting surfaces 562 that are inclined at specified angles to the orthogonal reflecting surfaces 561. In this embodiment, the inclined reflecting surfaces 562 are formed to incline downward toward the intermediate arcuate curve C3 from the maximum and minimum arcuate curves C1 and C2. Such inclined reflecting surfaces 562 have the angles of inclination thereof set such that the light emitted from one of the optical sensors 60 heads toward the other optical sensor 60.

Contrary to these reflecting surfaces 56, the absorbing surfaces 57 are surfaces on which no light is substantially reflected. The absorbing surfaces 57 are slightly recessed toward the right and black paint is applied thereto. The black paint absorbs the lights emitted from the optical sensors 60.

In this embodiment, the first section T1 is set on the orthogonal reflecting surface 561 (first reflecting surface); the second section T2 on the orthogonal reflecting surface 561 (first reflecting surface); the third section T3 on the absorbing surface 57; the fourth section T4 on the absorbing surface 57; the fifth section T5 on the inclined reflecting surface 562 (second reflecting surface); the sixth section T6 on the absorbing surface 57; and the seventh section T7 on the inclined reflecting surface 562 (second reflecting surface) for the first irradiation range R1.

Further, for the second irradiation range R2, the first section T1 is set on the orthogonal reflecting surface 561 (third reflecting surface); the second section T2 on the absorbing surface 57; the third section T3 on the orthogonal reflecting surface 561 (third reflecting surface); the fourth section T4 on the absorbing surface 57; the fifth section T5 on the absorbing surface 57; the sixth section T6 on the inclined reflecting surface 562 (fourth reflecting surface); and the seventh section T7 on the inclined reflecting surface 562 (fourth reflecting surface).

With the sheet stack P1 comprised of a maximum permissible number of sheets P placed on the lifting plate 32 (i.e. with the contact plate 35 located at a bottommost level), the relative positions of the striker 52 and the fan-shaped element 55 are set such that the first sections T1 of the fan-shaped element 55 are located below the rotary shaft 51 to face the optical sensors 60.

Hereinafter, a position located vertically below the rotary shaft 51 (shown by chain line in FIG. 6) is defined as a reference position B (light projecting position by the optical sensors 60) serving as a basis to express the posture of the fan-shaped element 55. With a maximum number of sheets P placed on the lifting plate 32, the first sections T1 face the reference position B. As the sheets P on the lifting plate 32 decrease in number by being successively dispensed, the fan-shaped element 55 rotates together with the rotary shaft 51 by the counterclockwise rotation of the rotary shaft 51 about its central axis via the striker 52 resulting from the upward movement of the contact plate 35. As a result, the position of the fan-shaped element 55 facing the reference position B successively changes from the first sections T1, to the second sections T2 and to the third sections T3. With hardly any sheets P on the lifting plate 32, the seventh sections T7 face the reference position B.

On the other hand, the pair of optical sensors 60 are aligned one above the other along the reference position B, wherein the first optical sensor 61 arranged above is so positioned as to face the first irradiation range R1 of the fan-shaped element 55 and the second optical sensor 62 arranged below is so positioned as to face the second irradiation range R2 of the fan-shaped element 55.

The first optical sensor 61 includes a first light emitting element 611 for emitting a light toward the first irradiation range R1 and a first light receiving element 612 for receiving the reflected light from the light irradiation region R of the fan-shaped element 55. The second optical sensor 62 includes a second light emitting element 621 for emitting a light toward then second irradiation range R2 and a second light receiving element 622 for receiving the reflected light from the light irradiation region R of the fan-shaped element 55.

If a light from the first light emitting element 611 is emitted toward the orthogonal reflecting surface 561 (first reflecting surface) of the first irradiation range R1, the first light receiving element 612 receives the resulting reflected light. Contrary to this, if a light from the first light emitting element 611 is emitted toward the inclined reflecting surface 562 (second reflecting surface) of the first irradiation range R1, the second light receiving element 622 receives the resulting reflected light.

Similarly, if a light from the second light emitting element 621 is emitted toward the orthogonal reflecting surface 561 (third reflecting surface) of the second irradiation range R2, the second light receiving element 622 receives the resulting reflected light. Contrary to this, if a light from the second light emitting element 621 is emitted toward the inclined reflecting surface 562 (fourth reflecting surface) of the second irradiation range R2, the first light receiving element 612 receives the resulting reflected light.

On the other hand, a light from the first light emitting element 611 is emitted toward the absorbing surface 57 of the first irradiation range R1 and if a light from the second light emitting element 621 is emitted toward the absorbing surface 57 of the second irradiation range R2, neither the first light receiving element 612 nor the second light receiving element receives the reflected light.

Accordingly, which sections T of the fan-shaped element 55 are facing the reference position B, i.e. how much the remaining amount of the sheets P is can be detected based on a combination of the light emitting element 611, 621 having emitted the light and the light receiving element 612, 622 having received the reflected light.

TABLE-1 below shows the relationship between the light emitting state and the light receiving state of the first and second light emitting elements 611, 621 and the first and second light receiving elements 612, 622 and the sections T of the fan-shaped element facing the reference position B. In a remarks column of TABLE-1 are shown examples of sentences to be outputted as character information to the LCD 114.

TABLE 1

| | $1^{ST}$ OPTICAL SENSOR 61 | | $2^{ND}$ OPTICAL SENSOR 62 | | |
|---|---|---|---|---|---|
| SECTIONS T | $1^{ST}$ L.E.E 611 | $1^{ST}$ L.R.E 612 | $2^{ND}$ L.E.E 621 | $2^{ND}$ L.R.E 622 | REMARKS (CHARACTER OUTPUT TO LCD 114) |
| $1^{ST}$ SECTIONS T1 | ○ | ○ | Δ | Δ | Maximum number of sheets. |
| $2^{ND}$ SECTION T2 | ○ | ○ | Δ | | Remaining sheets: about 70% of full capacity. |
| $3^{RD}$ SECTION T3 | ○ | | Δ | Δ | Remaining sheets: about 60% of full capacity. |
| $4^{TH}$ SECTION T4 | ○ | | Δ | | Remaining sheets: about 40% of full capacity. |
| $5^{TH}$ SECTION T5 | ○ | | Δ | ○ | Remaining sheets: about 30% of full capacity. |
| $6^{TH}$ SECTION T6 | ○ | Δ | Δ | | Remaining sheets: about 10% of full capacity. |
| $7^{TH}$ SECTION T7 | ○ | Δ | Δ | ○ | Replenish sheets. |

L.E.E denote "Light Emitting Element"
L.R.E denote "Light Receiving Element"

In TABLE-1, circle represents light emitted by the first light emitting element 611 and triangle represents light emitted by the second light emitting element 621. For example, in a state where the first sections T1 of the fan-shaped element 55 face the reference position B, the reflected light of the light emitted by the first light emitting element 611 is received by the first light receiving element 612 and the reflected light of the light emitted by the second light emitting element 621 is received by the second light receiving element 622 as shown in a column "1$^{ST}$ SECTIONS T1" of TABLE-1.

Contrary to this, if the seventh sections T7 of the fan-shaped element 55, for example, face the reference position B, the reflected light of the light emitted by the first light emitting element 611 is received by the second light receiving element 622 and the reflected light of the light emitted by the second light emitting element 621 is received by the first light receiving element 612 as shown in a column "7$^{TH}$ SECTION T7" of TABLE-1.

Further, empty spaces in TABLE-1 indicate that the lights emitted from the light emitting elements 611, 621 were absorbed by the absorbing surfaces 57 and accordingly the light receiving elements 612, 622 received substantially no reflected light.

FIGS. 8A to 8G are graphical representations of the contents of TABLE-1, wherein FIG. 8A shows a state where the first sections T1 of the fan-shaped element 55 face the optical sensors 60; FIG. 8B shows a state where the second sections T2 of the fan-shaped element 55 face the optical sensors 60; FIG. 8C shows a state where the third sections T3 of the fan-shaped element 55 face the optical sensors 60; FIG. 8D shows a state where the fourth sections T4 of the fan-shaped element 55 face the optical sensors 60; FIG. 8E shows a state where the fifth sections T5 of the fan-shaped element 55 face the optical sensors 60; FIG. 8F shows a state where the sixth sections T6 of the fan-shaped element 55 face the optical sensors 60; and FIG. 8G shows a state where the seventh sections T7 of the fan-shaped element 55 face the optical sensors 60.

As described above, the remaining amount of the sheets P can be discriminated by relating the combinations of the light emitting element 611, 621 having emitted the light and the light receiving element 612, 622 having received the reflected light to the remaining amounts of the sheets beforehand.

Figure 9:
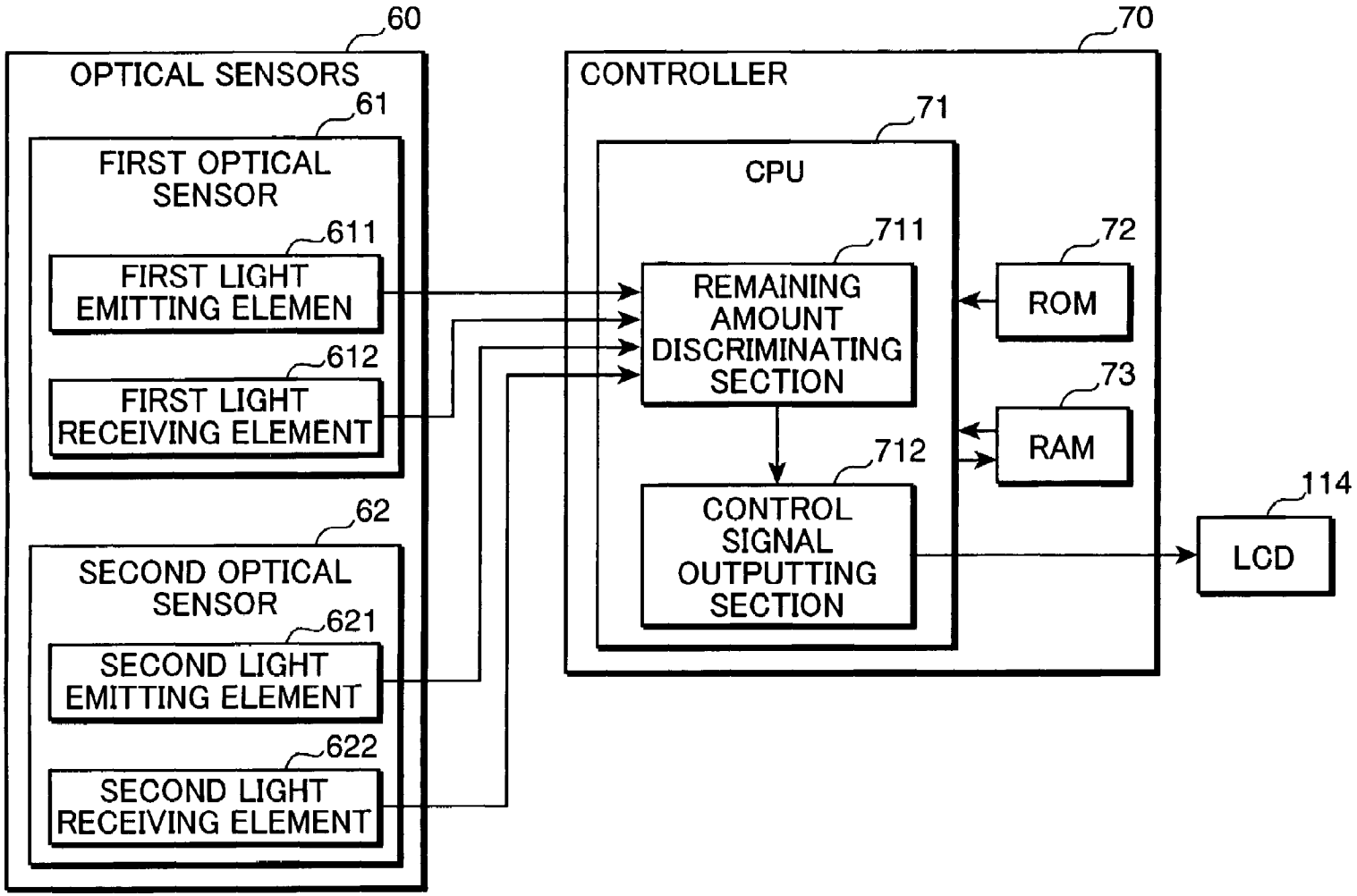
FIG. 9 is a block diagram showing one embodiment of the electrical construction of the sheet remainder detecting device.

FIG. 9 is a block diagram showing one embodiment of a control of the sheet remainder detecting device 40 by the controller 70. As shown in FIG. 9, a so-called computer is employed as the controller 70, which includes a CPU (central processing unit) 71 as an arithmetic processing unit, a ROM (read-only memory) 72 as a read only storage device attached to the CPU 71, and a RAM (random access memory) 73 in and from which information can be freely written and read and which is attached to the CPU 71.

A program for causing the controller 70 to execute this control, invariant data and the like are stored in the ROM 72. The RAM 73 is used as an area for temporarily saving various data temporarily generated during the control process.

The CPU 71 is provided with a remaining amount discriminating section 711 for discriminating the remaining amount of the sheets P in the sheet cassette 30, and a control signal outputting section 712 for outputting a control signal in order to notify the remaining amount of the sheets P to the LCD 114 based on the discrimination result of the remaining amount discriminating section 711.

In order to enable the remaining amount discriminating section 711 to discriminate the remaining amount of the sheets P, light emission signals and light reception signals from the optical sensors 60 are inputted to the remaining amount discriminating section 711. The relationship between the light emitting states and the light receiving states of the light emitting elements 611, 621 and the light receiving elements 612, 622 and the sections T of the fan-shaped element 55 facing the reference position B, and a table containing text data to be outputted to the LCD 114 for the display (i.e. table having the same contents as TABLE-1) are stored in the ROM 72.

The remaining amount discriminating section 711 judges, based on the light emission signal and the light reception signal from the optical sensors 60, the combination of the light emission by the light emitting element 611, 621 and the light reception by the light receiving element 612, 622 or the combination of the light emission by the light emitting element 611, 621 and no creation of the reflected light, and discriminates which sections T of the fan-shaped element 55 are facing the reference position B based on the judged combination by referring to the aforementioned table stored in the ROM 72.

The first and second light emitting elements 611, 621 are so controlled as to emit lights in turn. The remaining amount discriminating section 711 discriminates that the reflected light of the light emitted by the first light emitting element 611 was received by the first light receiving element 612 when a light reception signal is inputted from the first light receiving element 612 within a specified period after the input of a signal representing the light emission by the first light emitting element 611, whereas the remaining amount discriminating section 711 discriminates that the reflected light of the light emitted by the first light emitting element 611 was received by the second light receiving element 622 when a light reception signal is inputted from the second light receiving element 622 within the specified period after the input of the signal representing the light emission by the first light emitting element 611. If a light reception signal has been outputted from neither one of the light receiving elements 612, 622, the remaining amount discriminating section 711 discriminates that the light emitted by the first light emitting element 611 was absorbed by the absorbing surface 57 of the fan-shaped element 55.

Upon the lapse of the specified period after the light emission by the first light emitting element 611, the second light emitting element 621 is successively caused to emit light. Similar to the case of the first light emitting element 611, the remaining amount discriminating section 711 discriminates which of the light receiving elements 612, 622 received the reflected light of the light emitted by the second light emitting element 621 or neither of them received the reflected light.

The discrimination result of the remaining amount discriminating section 711 concerning the remaining amount of the sheets P is outputted to the control signal outputting section 712. The control signal outputting section 712 having received this discrimination result outputs a control signal for a specified character output to the LCD 114 by referring to the table stored in the ROM 72 based on this discrimination result (i.e. based on which sections T are facing the reference position B).

As shown in TABLE-1, examples of character outputs can be: "Maximum number of sheets" is displayed when the first sections T1 of the fan-shaped element 55 face the reference position B; "Remaining sheets: about 70% of full capacity" is displayed when the second sections T2 of the fan-shaped element 55 face the reference position B; "Remaining sheets: about 60% of full capacity" is displayed when the third sections T3 of the fan-shaped element 55 face the reference position B; "Remaining sheets: about 40% of full capacity" is displayed when the fourth sections T4 of the fan-shaped element 55 face the reference position B; "Remaining sheets: about 30% of full capacity" is displayed when the fifth sections T5 of the fan-shaped element 55 face the reference position B; "Remaining sheets: about 10% of full capacity" is displayed when the sixth sections T6 of the fan-shaped element 55 face the reference position B; and "Replenish sheets" is displayed when the seventh sections T7 of the fan-shaped element 55 face the reference position B.

As described in detail above, the sheet remainder detecting device 40 according to this embodiment is for detecting the remaining amount of the sheets P in the sheet stack P1 stored in the sheet cassette 30 of the sheet storing unit 12 constructed to dispense the sheets P one by one. The sheet remainder detecting device 40 is provided with the displacing member 50 displaceable according to the thickness of the sheet stack P1; the pair of optical sensors 60 including the first and second optical sensors 61, 62 having the first and second light emitting elements 611, 621 for emitting the lights toward the displacing member 50 and the first and second light receiving elements 612, 622 for receiving the reflected lights of the lights emitted by the light emitting elements 611, 621 from the displacing member 50; and the controller 70 for discriminating the remaining amount of the sheets P based on the detection signals from this pair of optical sensors 60. The displacing member 50 has a plurality of reflecting surfaces (reflecting surfaces 56 including the orthogonal reflecting surfaces 561 and the inclined reflecting surfaces 562) for reflecting the lights emitted from the first and second light emitting elements 611, 621 so that the corresponding light receiving elements 612, 622 or the other light receiving elements 622, 612 can receive the lights according to an amount of displacement.

With such a construction, the remaining amount of the sheets P stored in the sheet cassette 30 can be discriminated by the controller 70 by detecting which light receiving element 612, 622 has received the reflected light of the light emitted by which of the first and second light emitting elements 611, 621 with reference to the predetermined correspondence between the states of a plurality of reflecting surfaces 56 formed on the displacing member 50 (i.e. whether the reflecting surface is the orthogonal reflecting surface 561 or the inclined reflecting surface 562) and the remaining amounts of the stored sheets P.

In this way, by providing one pair of optical sensors 60 and providing the displacing member 50 with a plurality of reflecting surfaces 56 for reflecting the lights emitted from the light emitting elements 611, 621 of the optical sensors 60 so that the corresponding light receiving elements 612, 622 or the other light receiving elements 622, 612 can receive the lights according to an amount of displacement of the displacing member 50, many expensive optical sensors need not be arranged in correspondence with the amounts of displacement of the displacing member 50 unlike the prior art device, which can accordingly contribute to a reduction in parts cost.

In addition to the reflecting surfaces 56, the displacing member 50 has the absorbing surfaces 57 for absorbing the lights emitted from the first and second light emitting elements 611, 621. Thus, cases where the lights from the first and second light emitting elements 611, 621 are absorbed by the absorbing surfaces 57 and no reflected lights can be obtained can also be added as factors for detecting the displacement of the displacing member 50. Accordingly, the detectable amounts of displacement of the displacing member 50 can be more exactly divided and the remaining amount of the sheets P can be more precisely detected using a larger amount of information.

The controller 70 includes the remaining amount discriminating section 711 for discriminating the remaining amount of the sheets P based on the combination of the optical sensor 60 relating to the first or second light emitting element 611, 621 having emitted light and the mating optical sensor 60 relating to the first or second light receiving element 612, 622 having received the emitted light reflected by the reflecting surface 56 and the combination of the optical sensor 60 relating to the first or second light emitting element 611, 621 having emitted light and a state where the emitted light was absorbed by the absorbing surface 57 and neither one of the first and second light receiving elements 612, 622 received the reflected lights, and the control signal outputting section 712 for outputting a control signal to notify the LCD 114 of the remaining amount of the sheets P based on the discrimination result of the remaining amount discriminating section 711.

With such a construction, the remaining amount discriminating section 711 provided in the controller 70 discriminates the remaining amount of the sheets P based on the aforementioned combinations and this discrimination result is notified as the remaining amount of the sheets P to the LCD 114 based on the control signal outputted from the control signal outputting section 712. Therefore, a user can constantly confirm the remaining amount of the sheets P by looking at the content of this notification.

The present invention is not limited to the aforementioned embodiment and also embraces the contents of the following (1) to (5).

(1) The foregoing embodiment is described, taking the printer 10 as an example of an image forming apparatus to which the sheet remainder detecting device 40 is applied. According to the present invention, the image forming apparatus to which the sheet remainder detecting device 40 is applied is not limited to the printer 10 and may be a copier or a facsimile machine. The present invention is also applicable to mechanisms for feeding various kinds of sheets other than image forming apparatuses.

(2) In the foregoing embodiment, a pair of the first optical sensor 61 and the second optical sensor 62 are employed as the optical sensors 60. The present invention is not limited to a pair of optical sensors 60 and three or more optical sensors may be employed. This increases the combinations of the light emission and the light reception of the respective optical sensors 60, wherefore the remaining amount of the sheets P in the sheet cassette 30 can be detected with a resolution improved to such a level higher than in the foregoing embodiment.

(3) In the foregoing embodiment, the fan-shaped element 55 separate from the lifting plate 32 is employed as the displacing member 50. Instead, the lifting plate 32 itself may be employed as a displacing member, and the reflecting surfaces 56 and the absorbing surfaces 57 may be formed on one side surface of this lifting plate 32 and the remaining amount of the sheets P may be detected by emitting lights from the optical sensors 60 toward these reflecting surfaces 56 and absorbing surfaces 57. Such an embodiment obviates the need to provide the rotary shaft 51, the fan-shaped element 55 and the like, which accordingly contributes to a reduction in the number of parts and parts cost.

(4) Although the striker 52 projects obliquely downward to the front from the rotary shaft 51 in the foregoing embodiment, the striker 52 may, instead, project obliquely downward to the back from the rotary shaft 51. Such an embodiment enables the contact plate 35 to more smoothly come into contact with the striker 52 when the sheet cassette 30 is inserted into the cassette frame 20. However in such a case, the striker 52 rotates in clockwise direction about the rotary shaft 51 as the sheets P placed on the lifting plate 32 decrease in number, wherefore the remaining amount discriminating section 711 discriminates that the sheets P has run out when the optical sensors 60 detect the first sections T1 contrary to the foregoing embodiment.

(5) Although the sheets P are dispensed one by one in the foregoing embodiment, a plurality of sheets P may be dispensed at once. The present invention is also applicable to the detection of the thickness of the sheet stack P1 to which the sheets P are added one by one or a plurality of sheets P are added each time.

The aforementioned specific embodiment mainly embraces features of the inventions having the following constructions.

A sheet remainder detecting device according to one aspect of the present invention for detecting the remaining amount of sheets in a sheet stack, comprises a displacing member displaceable according to the thickness of the sheet stack; a first and a second optical sensors each having a light emitting element for emitting light toward the displacing member and a light receiving element for receiving the light emitted by the light emitting element and reflected by the displacing member; and a controller for discriminating the remaining amount of the sheets based on detection signals of the first and second optical sensors; the displacing member including a light irradiation region to be irradiated with the lights from the light emitting elements and movable according to an amount of displacement of the displacing member, the light irradiation region having a first reflecting surface for reflecting the light emitted from the light emitting element of the first optical sensor so that the light receiving element of the first optical sensor can receive light; a second reflecting surface for reflecting the light emitted by the light emitting element of the first optical sensor so that the light receiving element of the second optical sensor can receive light; a third reflecting surface for reflecting the light emitted from the light emitting element of the second optical sensor so that the light receiving element of the second optical sensor can receive light; and a fourth reflecting surface for reflecting the light emitted by the light emitting element of the second optical sensor so that the light receiving element of the first optical sensor can receive light.

Further, an image forming apparatus according another aspect of the present invention comprises a sheet storing unit for storing a sheet stack, an image forming unit for applying an image forming operation to a sheet dispensed from the sheet stack, and a sheet remainder detecting device for detecting the remaining amount of the sheets in the sheet stack, the sheet remainder detecting device having the above construction.

With such a construction, by relating the states of the first to fourth reflecting surfaces formed on the light irradiation region of the displacing member and the remaining amounts of the stored sheets to each other beforehand, the remaining amount of the sheets stored in the sheet storing unit can be discriminated by detecting which of the light receiving elements has received the light emitted from which of the light emitting elements. In addition, unlike the prior art, it is not necessary to arrange many expensive optical sensors in correspondence with amounts of displacement of the displacing member, which in turn contributes to a reduction in parts cost.

In the above construction, it is preferable that the first and third reflecting surfaces are orthogonal reflecting surfaces substantially orthogonal to light paths of lights emitted from the light emitting elements and the second and fourth reflecting surfaces are inclined reflecting surfaces inclined at specified angles to the orthogonal reflecting surfaces.

With such a construction, by dividing the reflecting surfaces into two kinds, i.e. the orthogonal reflecting surfaces substantially orthogonal to the light paths of the lights emitted by the light emitting elements and the inclined reflecting surfaces inclined at the specified angles to the orthogonal reflecting surfaces, a construction to reflect light emitted from the light emitting element of each optical sensor so that the light can be received by the light receiving element of this optical sensor or by the light receiving element of the other optical sensor can be simply realized.

In the above construction, the light irradiation region preferably further includes absorbing surfaces for absorbing the lights emitted from the light emitting elements.

With such a construction, cases where no reflected light can be obtained even if the light is emitted from the light emitting element to the absorbing surface can be added as a factor for the detection of the displacement of the displacing member. Accordingly, the detectable amounts of displacement of the displacing member can be more exactly divided and the remaining amount of the sheets can be more precisely detected using a larger amount of information.

In the above construction, it is preferable that the displacing member includes a rotary shaft rotatable about its central axis according to the remaining amount of the sheets in the sheet stack and a fan-shaped member fixed to this rotary shaft, and that the light irradiation region is formed on the fan-shaped element. With such a construction, the resolution in the detection of the remaining amount of the sheet can be improved since an amount of rotation of the rotary shaft according to a change of the sheet stack is amplified by the fan-shaped member.

In this case, it is preferable that the light irradiation region includes a first irradiation range formed along an arcuate curve of the fan-shaped member and having specified radius of curvature and width, and a second irradiation range having a radius of curvature different from that of the first irradiation range and a specified width, that the first irradiation range faces the first optical sensor and includes the first and second reflecting surfaces, and that the second irradiation range faces the second optical sensor and includes the third and fourth reflecting surfaces. With this construction, the light irradiation region can be efficiently arranged taking advantage of the shape characteristic of the fan-shaped member.

In the above construction, it is preferable that the light irradiation region includes a first and a second irradiation ranges having specified widths, that the first irradiation range faces the first optical sensor and includes the first reflecting surface, the second reflecting surface and an absorbing surface for absorbing light, and that the second irradiation range faces the second optical sensor and includes the third reflecting surface, the fourth reflecting surface and an absorbing surface for absorbing light. With this construction, the reflecting surfaces and the absorbing surfaces are incorporated, thereby forming the light irradiation region having an excellent resolution.

In the above construction, the controller preferably includes a remaining amount discriminating section for discriminating the remaining amount of the sheets based on the combination of a light emitting operation of the light emitting element of the first or second optical sensor and the light receiving element of the first or second optical sensor having received the light on the basis of the light emitting operation, and a control signal outputting section for outputting a control signal to notify a specified notifying element of the remaining amount of the sheets based on the discrimination result of the remaining amount discriminating section.

Alternatively, the controller preferably includes a remaining amount discriminating section for discriminating the remaining amount of the sheets based on the combination of a light emitting operation of the light emitting element of the first or second optical sensor and the light receiving element of the first or second optical sensor having received the reflected light by any one of the first to fourth reflecting surfaces on the basis of the light emitting operation and the combination of the light emitting operation of the light emitting element of the first or second optical sensor and a state where the light on the basis of the light emitting operation was absorbed by the absorbing surface and the light receiving element of neither the first nor second optical sensor received light, and a control signal outputting section for outputting a control signal to notify a specified notifying element of the remaining amount of the sheets based on the discrimination result of the remaining amount discriminating section.

With these constructions, the remaining amount discriminating section provided in the controller discriminates the remaining amount of the sheets based on the aforementioned combinations and this discrimination result is notified as the remaining amount of the sheets by the notifying element based on the control signal outputted from the control signal outputting section. Therefore, a user can constantly confirm the remaining amount of the sheets by looking at the content of this notification.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

This application is based on patent application No. 2005-366393 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A sheet remainder detecting device for detecting the remaining amount of sheets in a sheet stack, comprising: a displacing member displaceable according to the thickness of the sheet stack; a first and a second optical sensors each having a light emitting element for emitting light toward the displacing member and a light receiving element for receiving the light emitted by the light emitting element and reflected by the displacing member; and a controller for discriminating the remaining amount of the sheets based on detection signals of the first and second optical sensors; the displacing member including a light irradiation region to be irradiated with the lights from the light emitting elements and movable according to an amount of displacement of the displacing member, and the light irradiation region having:

a first reflecting surface for reflecting the light emitted from the light emitting element of the first optical sensor so that the light receiving element of the first optical sensor can receive the reflected light emitted from the first optical sensor;

a second reflecting surface for reflecting the light emitted by the light emitting element of the first optical sensor so that the light receiving element of the second optical sensor can receive the reflected light received from the first optical sensor;

a third reflecting surface for reflecting the light emitted from the light emitting element of the second optical sensor so that the light receiving element of the second optical sensor can receive the reflected light received from the second optical sensor;

and a fourth reflecting surface for reflecting the light emitted by the light emitting element of the second optical sensor so that the light receiving element of the first optical sensor can receive the reflected light received from the second optical sensor.

2. A sheet remainder detecting device according to claim 1, wherein:

the first and third reflecting surfaces are orthogonal reflecting surfaces substantially orthogonal to light paths of lights emitted from the light emitting elements, and the second and fourth reflecting surfaces are inclined reflecting surfaces inclined at specified angles to the orthogonal reflecting surfaces.

3. A sheet remainder detecting device according to claim 1, wherein the light irradiation region further includes absorbing surfaces for absorbing the lights emitted from the light emitting elements.

4. A sheet remainder detecting device according to claim 1, wherein the displacing member includes a rotary shaft rotatable about a central axis thereof according to the remaining amount of the sheets in the sheet stack, and a fan-shaped member fixed to the rotary shaft, the light irradiation region being formed on the fan-shaped member.

5. A sheet remainder detecting device according to claim 4, wherein:

the light irradiation region includes a first irradiation range formed along an arcuate curve of the fan-shaped member and having specified radius of curvature and width, and a second irradiation range having a radius of curvature different from that of the first irradiation range and a specified width, the first irradiation range faces the first optical sensor and includes the first and second reflecting surfaces, and the second irradiation range faces the second optical sensor and includes the third and fourth reflecting surfaces.

6. A sheet remainder detecting device according to claim 1, wherein:

the light irradiation region includes a first and a second irradiation ranges surface having specified widths, the first irradiation range faces the first optical sensor and includes the first reflecting surface, the second reflecting surface and an absorbing surface for absorbing light, and the second irradiation range faces the second optical sensor and includes the third reflecting surface, the fourth reflecting surface and an absorbing surface for absorbing light.

7. A sheet remainder detecting device according to claim 1, wherein the controller includes:

a remaining amount discriminating section for discriminating the remaining amount of the sheets based on the combination of a light emitting operation of the light emitting element of the first or second optical sensor and the light receiving element of the first or second optical sensor having received the light on the basis of the light emitting operation, and a control signal outputting section for outputting a control signal to notify a specified notifying element of the remaining amount of the sheets based on the discrimination result of the remaining amount discriminating section.

8. A sheet remainder detecting device according to claim 3, wherein the controller includes:

a remaining amount discriminating section for discriminating the remaining amount of the sheets based on the combination of a light emitting operation of the light emitting element of the first or second optical sensor and the light receiving element of the first or second optical sensor having received the reflected light by any one of the first to fourth reflecting surfaces on the basis of the light emitting operation and the combination of the light emitting operation of the light emitting element of the first or second optical sensor and a state where the light on the basis of the light emitting operation was absorbed by the absorbing surface and the light receiving element of neither the first nor second optical sensor received light, and a control signal outputting section for outputting a control signal to notify a specified notifying element of the remaining amount of the sheets based on the discrimination result of the remaining amount discriminating section.

9. An image forming apparatus, comprising: a sheet storing unit for storing a sheet stack, an image forming unit for applying an image forming operation to a sheet dispensed from the sheet stack, and a sheet remainder detecting device for detecting the remaining amount of the sheets in the sheet stack, wherein the sheet remainder detecting device includes: a displacing member displaceable according to the thickness of the sheet stack; a first and a second optical sensors each having a light emitting element for emitting light toward the displacing member and a light receiving element for receiving the light emitted by the light emitting element and reflected by the displacing member; and a controller for discriminating the remaining amount of the sheets based on detection signals of the first and second optical sensors; the displacing member having a light irradiation region to be irradiated with the lights from the light emitting elements and movable according to an amount of displacement of the displacing member, and the light irradiation region having:

a first reflecting surface for reflecting the light emitted from the light emitting element of the first optical sensor so that the light receiving element of the first optical sensor can receive the reflected light emitted from the first optical sensor;

a second reflecting surface for reflecting the light emitted by the light emitting element of the first optical sensor so that the light receiving element of the second optical sensor can receive the reflected light received from the first optical sensor;

a third reflecting surface for reflecting the light emitted from the light emitting element of the second optical sensor so that the light receiving element of the second optical sensor can receive the reflected light received from the second optical sensor;

and a fourth reflecting surface for reflecting the light emitted by the light emitting element of the second optical sensor so that the light receiving element of the first optical sensor can receive the reflected light received from the second optical sensor.

10. An image forming apparatus according to claim 9, wherein:

the first and third reflecting surfaces are orthogonal reflecting surfaces substantially orthogonal to light paths of lights emitted from the light emitting elements, and the second and fourth reflecting surfaces are inclined reflecting surfaces inclined at specified angles to the orthogonal reflecting surfaces.

11. An image forming apparatus according to claim 9, wherein the light irradiation region further includes absorbing surfaces for absorbing the lights emitted from the light emitting elements.

12. An image forming apparatus according to claim 9, wherein the displacing member includes a rotary shaft rotatable about a central axis thereof according to the remaining amount of the sheets in the sheet stack, and a fan-shaped member fixed to the rotary shaft, the light irradiation region being formed on the fan-shaped member.

13. An image forming apparatus according to claim 12, wherein:

the light irradiation region includes a first irradiation range formed along an arcuate curve of the fan-shaped member and having specified radius of curvature and width, and a second irradiation range having a radius of curvature different from that of the first irradiation range and a specified width, the first irradiation range faces the first optical sensor and includes the first and second reflecting surfaces, and the second irradiation range faces the second optical sensor and includes the third and fourth reflecting surfaces.

14. An image forming apparatus according to claim 9, wherein:

the light irradiation region includes a first and a second irradiation ranges having specified widths, the first irradiation range faces the first optical sensor and includes the first reflecting surface, the second reflecting surface and an absorbing surface for absorbing light, and the second irradiation range faces the second optical sensor and includes the third reflecting surface, the fourth reflecting surface and an absorbing surface for absorbing light.

15. An image forming apparatus according to claim 9, wherein the controller includes:

a remaining amount discriminating section for discriminating the remaining amount of the sheets based on the combination of a light emitting operation of the light emitting element of the first or second optical sensor and the light receiving element of the first or second optical sensor having received the light on the basis of the light emitting operation, and a control signal outputting section for outputting a control signal to notify a specified notifying element of the remaining amount of the sheets based on the discrimination result of the remaining amount discriminating section.

16. An image forming apparatus according to claim 11, wherein the controller includes:

a remaining amount discriminating section for discriminating the remaining amount of the sheets based on the combination of a light emitting operation of the light emitting element of the first or second optical sensor and the light receiving element of the first or second optical sensor having received the reflected light by any one of the first to fourth reflecting surfaces on the basis of the light emitting operation and the combination of the light emitting operation of the light emitting element of the first or second optical sensor and a state where the light on the basis of the light emitting operation was absorbed by the absorbing surface and the light receiving element of neither the first nor second optical sensor received light, and a control signal outputting section for outputting a control signal to notify a specified notifying element of the remaining amount of the sheets based on the discrimination result of the remaining amount discriminating section.

* * * * *